US005413024A

United States Patent [19]

Plummer

[11] Patent Number: 5,413,024

[45] Date of Patent: May 9, 1995

[54] DISPOSABLE FLARE DISPENSER MAGAZINE FOR INFRARED DECOY FLARES

[75] Inventor: Thomas W. Plummer, Germantown, Tenn.

[73] Assignee: Alliant Techsystems Inc., Hopkins, Minn.

[21] Appl. No.: 92,775

[22] Filed: Jul. 16, 1993

[51] Int. Cl.[6] ..... F41F 3/042

[52] U.S. Cl. ..... 89/1.816; 89/1.59

[58] Field of Search ..... 89/1.816, 1.817, 1.818, 89/1.59, 1.804, 1.11; 102/335, 338

[56] References Cited

U.S. PATENT DOCUMENTS

| | | | |
|---|---|---|---|
| 2,844,073 | 7/1958 | Ré et al. | 89/1.817 |
| 3,319,522 | 5/1967 | Gould et al. | 89/1.816 |
| 3,754,497 | 8/1973 | Rusbach | 89/1.816 |
| 3,988,961 | 11/1976 | Banta et al. | 89/1.816 |
| 4,063,485 | 12/1977 | Carter et al. | 89/1.816 |
| 4,296,669 | 10/1981 | Debona et al. | 89/1.816 |
| 4,429,611 | 2/1984 | Oldham et al. | 89/1.816 |
| 4,604,939 | 8/1986 | Hoffmeister et al. | 89/1.816 |
| 4,635,527 | 1/1987 | Carrier et al. | 89/1.816 |
| 4,679,483 | 7/1987 | Wrana | 89/1.59 |
| 5,058,481 | 10/1991 | Drummond et al. | 89/1.816 |

*Primary Examiner*—David Brown
*Attorney, Agent, or Firm*—Hugh D. Jaeger

[57] ABSTRACT

A disposable flare dispenser magazine for infrared decoy flares providing the ability to quick load a plurality of infrared decoy flares to a flight aircraft during combat rearming. The magazine, in conjunction with a cover, is incorporated as a packaging and shipping container for the resident infrared flares, as well as for loading the flares on an aircraft.

3 Claims, 3 Drawing Sheets

DISPOSABLE FLARE DISPENSER MAGAZINE FOR INFRARED DECOY FLARES

BACKGROUND OF THE INVENTION

1. Field of the Invention

The present invention pertains to a magazine for pyrotechnic devices, and more particularly, pertains to a disposable flare dispenser magazine for rapid reloading of a group of infrared decoy flares aboard an aircraft.

2. Description of the Prior Art

Prior art flare dispensers, such as an MJU 12/A magazine are fashioned of aluminum, are down loaded from an aircraft, and are then manually reloaded. This means loading the magazine with each of the 15 MJU-7A/B flares and up loading the magazine again for the next usage.

The old dispenser is permanent to the particular aircraft. It contains 15 MJU-7A/B infrared decoy flares with a BBU 36/B squib inserted into the flare prior to flying a mission. The flares are dispensed during the mission and upon return, each dispenser is down loaded and the empty flare cans are pushed out of the magazine. New flares and squibs are unpackaged, and again a squib is inserted into the flare and loaded into the magazine/dispenser.

The prior art dispenser MJU 12/A magazine is loaded with flares and squibs, flown on a mission, down loaded of flares and squibs, and used again and again. Short aircraft down time during intense air combat often suffered due to the length of time required to reload flares into the aircraft's MJU 12 /A magazine.

The present invention provides a prepackaged disposable quick change flare dispenser magazine for the deployment of flares, such as the MJU-A/B flares and for the shipping containment of such packaged flares to a reloading site of an air field.

SUMMARY OF THE INVENTION

The general purpose of the present invention is to provide a disposable flare dispenser magazine fashioned of glass-filled nylon, and including a plurality of compartments arranged in an array for the accommodation of a plurality of desired infrared decoy flares. The flares, including an integral squib and a case, are preloaded into the magazine compartments off site and are transferred to the aircraft armament loading site. The magazine, along with a magazine cover, are also incorporated as a shipping container for transportation requirements. Once the cover is removed, the magazine, replete with the previously loaded infrared decoy flares, is loaded onto the receptor device on the aircraft. The mission is flown and upon return, the spent magazine is removed and discarded for recycling upon which another live magazine is installed on the aircraft which is then dispatched quickly back to the combat zone.

The present invention operates the same in the air as prior art devices, and provides for compatibility with present day flare mounting sites found on combat aircraft. The invention is suitable for use with the AN-/ALE 40 or AN/ALE 45 dispenser system for the F16, F4, F5 and the F104 aircraft, as well as other aircraft.

According to one embodiment of the present invention, there is provided a disposable flare dispenser magazine formed by a joined front member and rear member halves. The disposable flare dispenser magazine includes a top, a bottom and opposing side members.

Included at the rear of the disposable flare dispenser magazine is a mounting flange and at the front is a support flange. A plurality of reinforcement ribs align along the top, the bottom, the sides, and between the rear mounting flange and the front support flange. An array of compartments are formed by a matrix of vertical and horizontal members aligned between the top, the bottom and the sides. The compartments have four sides and are open at each end. Flares are secured in the chambers by a plate which attaches to the rear flange.

One significant aspect and feature of the present invention is a disposable flare dispenser magazine which can be preloaded with infrared decoy flares, deployed, and then down loaded and discarded.

Another significant aspect and feature of the present invention is a disposable flare dispenser magazine which serves as a shipping container.

Still another significant aspect and feature of the present invention is a disposable flare dispenser magazine which is usable immediately without the need of reloading.

An additional significant aspect and feature of the present invention is a disposable flare dispenser magazine which saves time in the reloading of decoy flares.

A still additional significant aspect and feature of the present invention is a single complete system where the flares and squibs are prepackaged, thus eliminating manual reloading between sorties.

A further significant aspect and feature of the present invention is cost effectiveness.

Having thus described the embodiments of the present invention, it is one object hereof to provide a disposable flare dispenser magazine.

One object of the present invention is a disposable flare dispenser magazine for infrared decoy flares.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
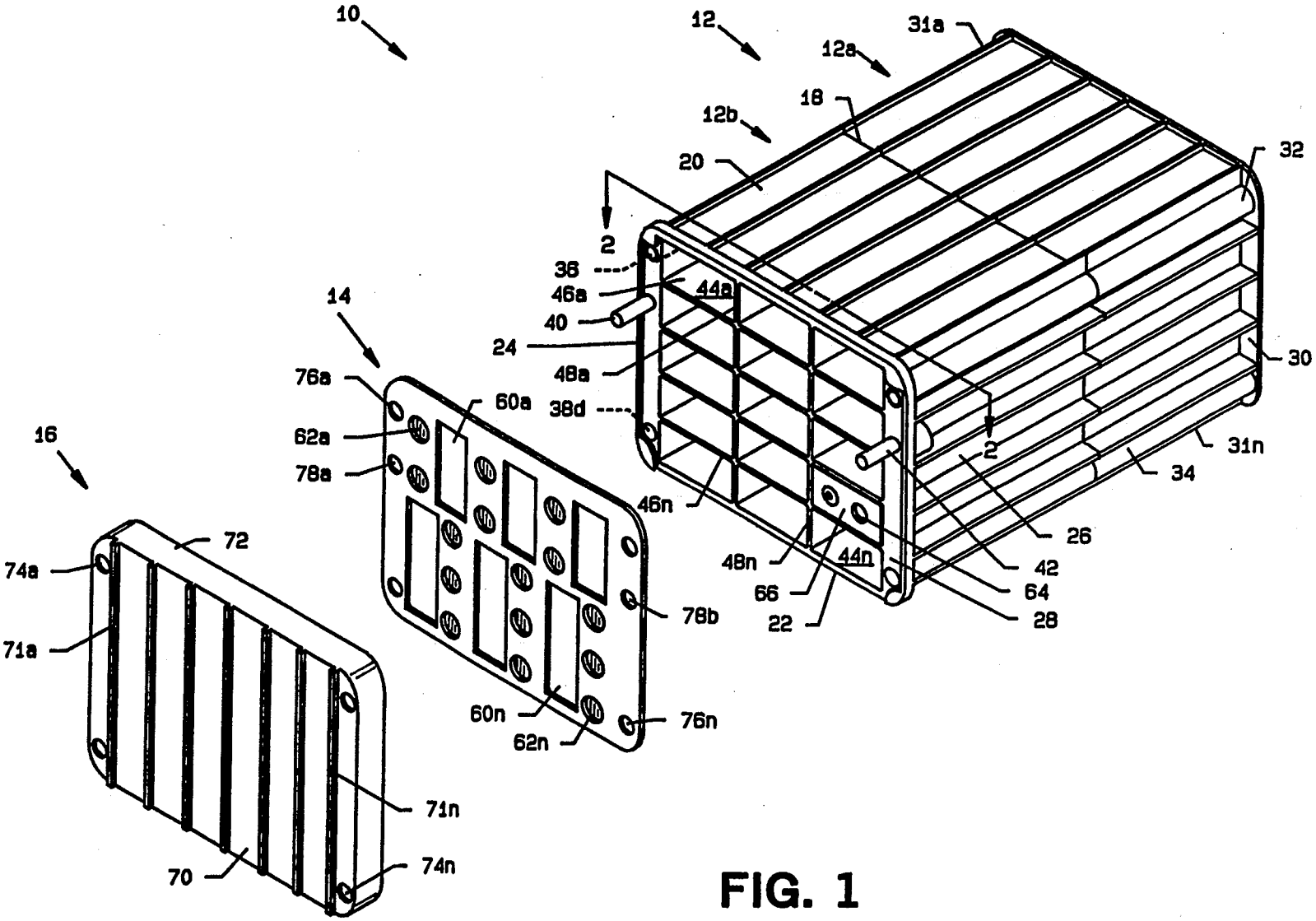
FIG. 1 illustrates an exploded perspective view of the disposable flare dispenser magazine, the present invention.

FIG. 1 illustrates an exploded perspective view of a disposable flare dispenser magazine 10, including the magazine 12, rear retainer plate 14 and a shipping cover 16. The magazine 12 is formed of a front half **12*a* and a rear half 12*b*, which are secured to each other at a seam 18 to form substantially continuous surfaces throughout and within. The magazine 12 includes a top 20, a bottom 22, and left and right sides 24 and 26, respectively, between the top 20 and the bottom 22. A rear mounting flange 28 and a front support flange 30 intersect the top 20, the sides 24 and 26, and the bottom 22. A plurality of reinforcement ribs 31*a*–31*n* extend and align along the top 20 and the sides 24 and 26, and between the rear mounting flange 28 and the front support flange 30. Upper and lower fastener support tubes 32 and 34 extend along the right side 26 and between the rear mounting flange 28 and the front support flange 30. In a similar manner, upper and lower fastener support tubes 36 and 38 extend along the left side 24 and between the rear mounting flange 28 and the front support flange 30. Fastener members align in the fastener support tubes 32–38 as later described in FIG. 3. Alignment pins 40 and 42 extend from the rear mounting flange 28, through corresponding body holes in the rear retainer plate 14 to ultimately align in the launcher mounting pad on the air frame. A plurality of compartments 44***a*–44*n* are formed between the top 20, the bottom 22 and sides 24 and 26 by matrix of formed horizontal members 46*a*–46*n* and vertical matrix members 48*a*–48*n*. The rearward edges of the top 20, the bottom 22, the sides 24 and 26, the horizontal matrix members 46*a*–46*n*, and the vertical matrix members 48*a*–48*n* provide surfaces for engagement with the rim of a flare case.

The rear retainer plate 14 includes necessary ports for the firing of the contained flares including a plurality of orifices 60*a*–60*n* through which contact is accomplished between a squib and an on board electrical contact panel. Alignment dimples 62*a*–62*n* extend toward the front of the rear retainer plate to align with corresponding dimples such as dimple 64 in the end of flare 66 illustrated in one of the compartments 44*a*–44*n*. Any possibly misaligned flare would preclude proper and correct fastening of the rear retainer plate 14 to the rear mounting flange 28.

The shipping cover 16 includes a reinforced ribbed surface 70 and a continuous lip 72 surrounding the ribbed surface 70, and aligns over the rear retainer plate 14 and the rear mounting flange 28. Reinforcement ribs 71*a*–71*n* align along the surface 70 to enhance structured integrity. A plurality of body holes 74*a*–74*n* align with corresponding body holes 76*a*–76*n* in the rear retainer plate 14, as well as with the corresponding fastener support tubes 32–38. Body holes 78*a* and 78*b* align with the left alignment pin 40 and the right alignment pin 42 of the magazine 12.

Figure 2:
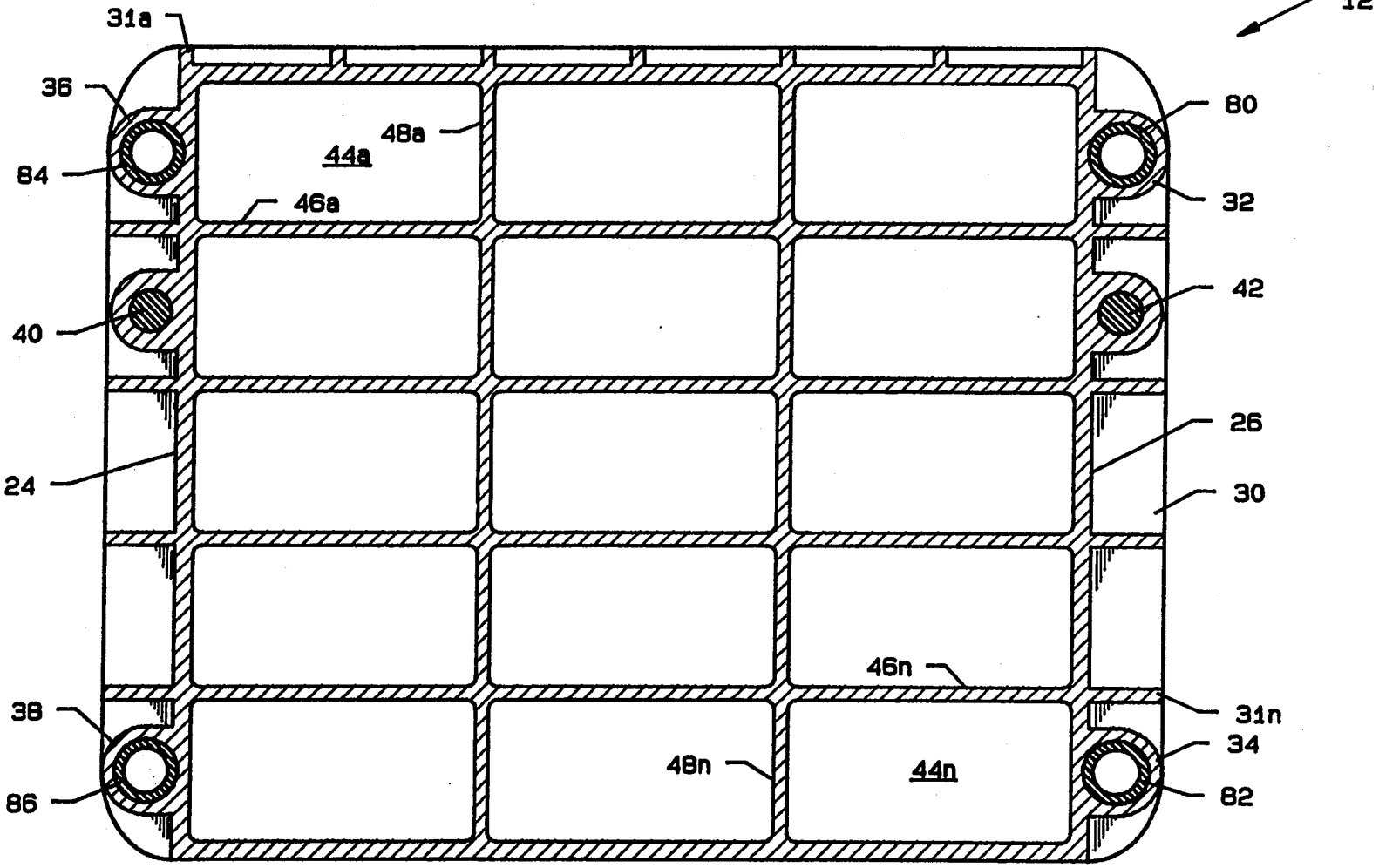
FIG. 2 illustrates a cross-sectional view of the magazine along line 2—2 of FIG. 1; and, FIG. 3 illustrates a cutaway side view of the magazine.

FIG. 2 illustrates a cross-sectional view of the magazine 12 along line 2—2 of FIG. 1 where all numerals correspond to those elements previously described. Illustrated in particular are the ends of the fastener devices 80–86 contained in the interior of the fastener support tubes 32–38, respectively. These fastener devices secure to mounting studs of the aircraft launcher mounting.

Figure 3:
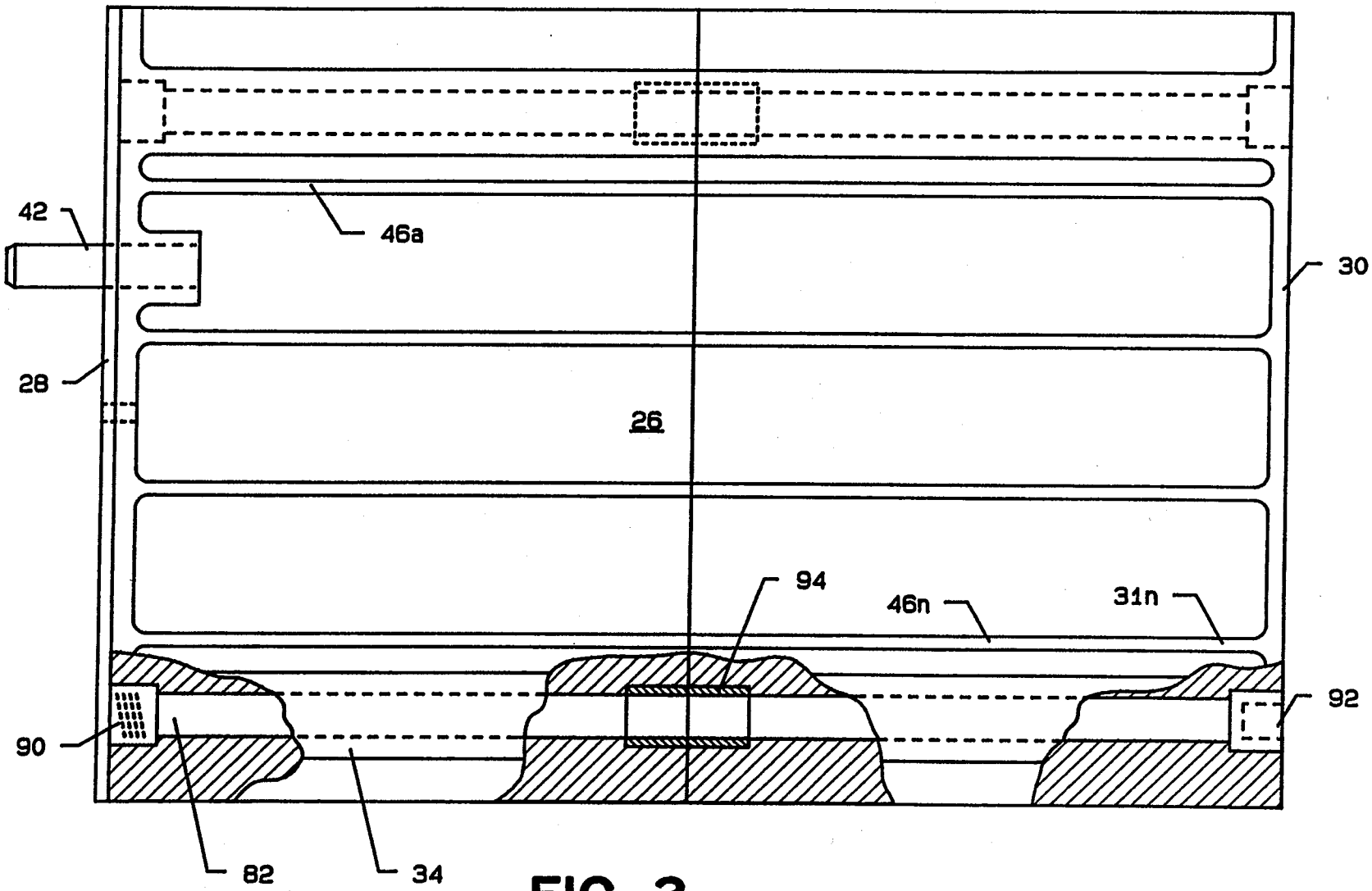

FIG. 3 illustrates a cutaway side view of the magazine 12 illustrating the fastener device 82, which is similar in design and operation to fastener devices 80, 84 and 86. The fastener device 82 includes a central shaft 88 having an internally threaded member 90 for attachment to a launcher pad stud on one end. Opposing the internally threaded member 90 and at the other end of the central shaft 82 is a member 92 having an internal allen head. The central shaft aligns in a bushing 94 affixed in the lower fastener support tube 34. Actuation of the allen head member 92 and other like corresponding fastening members rotationally actuates the fastening device, such as device 82 to secure the magazine to the aircraft mounting launch pad studs.

MODE OF OPERATION

The disposable flare dispenser magazine is for infrared decoy flares, such as the flares in the copending patent application. The magazine is for shipping, storage, and use on an aircraft. The magazine is operational in providing for the firing of flares from the aircraft.

Various modifications can be made to the present invention without departing from the apparent scope hereof.

We claim:

1. A disposable flare dispenser magazine for infrared decoy flares comprising:

a. a magazine including aligned substantially equal front half and back half sections, each section including four corners, a fastener support means to be adjacent to each corner of said magazine and extending through said front half and said back half for engaging said halves together, a plurality of compartments spaced in said magazine, and alignment means extending from said rear half; and, b. a rear retainer plate including a plurality orifice means and spaced holes to receive said alignment means.

2. A disposable flare dispenser magazine for infrared decoy flares comprising:

a. a magazine including aligned substantially equal front half and back half sections, each section including four corners, a fastener support tube means adjacent to each corner of said magazine and extending through said front half and said back half for engaging said halves together, a plurality of compartments spaced in said magazine, and alignment means extending from said rear half;

b. a rear retainer plate including a plurality orifice means and spaced holes to receive said alignment means; and, c. means for engaging a shipping cover.

3. A disposable flare dispenser magazine for infrared decoy flares comprising:

a. a magazine including aligned substantially equal front half and back half sections, each section including four corners, means for engaging said halves together, a plurality of compartment means spaced in said magazine for receiving a disposable flare in each of said compartment means, and alignment means extending from said rear half; and, b. a rear retainer plate including a plurality orifice means and spaced holes to receive said alignment means.

* * * * *